US006179734B1

(12) United States Patent
Bravard

(10) Patent No.: US 6,179,734 B1
(45) Date of Patent: Jan. 30, 2001

(54) BALL GAME METHOD OF PLAY AND BASE

(76) Inventor: Bryan J. Bravard, 1540 Andrews Dr., Pleasant Hill, IA (US) 50317

( * ) Notice: Under 35 U.S.C. 154(b), the term of this patent shall be extended for 0 days.

(21) Appl. No.: 09/353,725

(22) Filed: Jul. 14, 1999

Related U.S. Application Data

(60) Provisional application No. 60/093,091, filed on Jul. 16, 1998.

(51) Int. Cl.[7] ..... A63B 69/00

(52) U.S. Cl. ..... 473/499; 473/500; 473/468; 473/415; 273/DIG. 26

(58) Field of Search ..... 473/415–421, 473/468, 434, 499–501, FOR 102, FOR 212; 273/DIG. 30; 446/180–183, 404, 297, 397; 5/904

(56) References Cited

U.S. PATENT DOCUMENTS

| | | | | |
|---|---|---|---|---|
| 171,038 | | 12/1875 | O'Neill . | |
| 311,278 | * | 1/1885 | Williams | 473/500 |
| 1,066,773 | | 7/1913 | Wills . | |
| 1,207,191 | * | 12/1916 | Madden | 273/DIG. 26 |
| 2,298,689 | | 10/1942 | Ferris . | |
| 2,440,042 | | 4/1948 | Friedman . | |
| 3,091,454 | * | 5/1963 | Sam | 473/414 |
| 4,309,031 | * | 1/1982 | O'Meara | 473/415 |
| 5,562,289 | * | 10/1996 | McAllister | 473/468 |
| 5,613,855 | * | 3/1997 | Thompson et al. | 434/247 |

OTHER PUBLICATIONS

Kick The Can; Darwin A. Hindman; pp. 318, 322, 1956.*
The Complete Book Of Games; Clement Wood & Gloria Goddard; pp. 616–617, 630–631, 1940.*

* cited by examiner

*Primary Examiner*—Jeanette Chapman
*Assistant Examiner*—Mitra Aryanpour
(74) *Attorney, Agent, or Firm*—G. Brian Pingel

(57) ABSTRACT

A new game is disclosed, involving objectives similar to American baseball but with equipment and rules of play tailored for young children. In this new game, there is a bat and a ball that is hit off a tee. The boundaries on the playing field are defined as a right boundary, which is a visual line between teebase and the base placed in a position similar to that of first base on a regular baseball field and a left boundary, which is a visual line between teebase and a boundary marker placed in a position angled to the left of teebase and selected according to the number and skill level of the players. There is only one base and when a batter hits the ball off the tee, he runs to a base placed on the right boundary. The base includes an air bladder that is connected to a sound generating device to produce a sound when the base is stepped on. If the batter steps on the base before a player on the other team catches the ball before it reaches the ground or fields the ball and yells "Blast!", the batter is safe and scores a point. Otherwise, the batter is out.

12 Claims, 6 Drawing Sheets

BALL GAME METHOD OF PLAY AND BASE

REFERENCE TO RELATED APPLICATION

This application claims the benefit of U.S. Provisional Application No. 60/093,091 filed Jul. 16, 1998.

BACKGROUND OF THE INVENTION

1. Field of Invention

The invention relates to an apparatus and method for playing a new game similar to American baseball. More specifically, the method and apparatus teach young children the fundamentals of American baseball by incorporating many aspects of the game.

2. Description of Prior Art

Other games have been modeled after American baseball in an effort to simplify the game enough to be enjoyable for those unskilled in the fundamentals. These games sometimes employ a larger bat and larger ball to make hitting the ball easier, a softer ball which reduces injuries from inaccurate throws and catches, or different rules to accommodate for lower skill levels to make playing and scoring easier. Examples are softball, whiffle ball, and teeball. In teeball, the relatively high skill levels required for a player to pitch a ball and another to hit it with a bat have been eliminated by placing the ball on a holder, the tee, and allowing the player to hit the ball with the bat from that stationary position. However, each of these games is still somewhat complex, requires the traditional running pattern to score a point which includes three bases and home plate, results in few players actually scoring, can be time consuming, and involves skill levels above those of the novice, especially young children. In short, the prior art still leaves some players with the feeling of frustration which is counterproductive to improving skills and robs players of a sense of accomplishment and fun.

Another problem with baseball and its variations is the difficulty in detecting whether a player reached the base before the ball is caught and is, thus, safe. Although it is known in the prior art to provide a base that indicates when a player has reached the base by emitting audible sound or visible light, none of the prior art devices are acceptable for use in the present invention. For example, bases disclosed in U.S. Pat. No. 171,038 to O'Neill and U.S Pat. No. 2,298,689 to Ferris require a box containing a bell or circuit closing mechanisms to be set into the ground. The base sits on a pressure-sensitive frame so that when a player steps on the base the bell rings or the circuit to an electrical indicating device is closed. This, of course, means a box must be set into the ground. While this may work for permanent fields, for everyday play and on fields that are also used for other sports, the semi-buried box could prove inconvenient and hazardous.

Another base disclosed in a U.S. Pat. No. 1,066,773 to Wills, is similar but requires no box set into the ground. Here, the base is constructed of two plates having electric contact portions mounted on their edges and kept slightly apart by springs so that when a player steps on the upper of the two plates, the contact portions touch together, completing an electric circuit. The contact portions are connected to a bell or other signaling device which indicates when the circuit is complete. Some of the drawbacks of this base are its requirement for a source of electricity and the requirement that the indicator be located so as not to create a hazard to the player or the equipment.

The major drawback of such prior art bases is that they were designed to be used in the game of baseball and can not avoid missignals caused by a first baseman stepping on the base while playing. A more recent U.S. Pat. No. 2,440,042, to Friedman, discloses another base that contains switches. The switches are activated by magnets in the players' shoes so that when the shoe of a baseman touches the base, one light will be illuminated and when the shoe of a runner touches the base, a different light will be illuminated. However, the lights are located on the exterior of the base, requiring them to be wired to the base and placed where they are easy to use yet out of the way. Said base also requires that each player's shoes must be equipped with the appropriately polarized magnets. While this invention cures missignals, it also requires specialized equipment for each player and careful placement of the indicator lights and their connective wires to minimize harm to equipment and players.

It is one object of the present invention to provide a variation of traditional American baseball that is much less complex than others, teaches the fundamentals of the game, and is more appropriate for young children's physical skill levels and cognitive abilities.

It is another object of the present invention to provide a method of play that includes equipment specially designed to assist the player in developing skills including a portable, easily installed base that indicates by sound when a player has reached it but does not missignal. Further, the present invention contemplates equipment that does not create a hazard to the players by virtue of its installation.

SUMMARY OF THE INVENTION

In accordance with the present invention, a new game is disclosed involving many of the same elements and objectives as American baseball, but designed specifically for developing the skills for and teaching the fundamentals of baseball to young children. The playing field is arranged similarly to baseball with a teebase and right and left side boundaries defining a fair ball area. However, there is only one base on the field which is located on one of the boundaries. It emits sound when depressed. The right side boundary is formed by the visual line between teebase and the base placed in a position similar to first base on a baseball field; the left side boundary is formed by the visual line between teebase and the boundary marker. The size of the field is adjusted for the skill level and number of players by placement of the boundary marker. A ball similar in shape to a baseball, but larger and softer, is placed on a tee and hit by a batter with a bat shaped similarly to a baseball bat but also larger and softer.

There are two teams of players both of preferably equal number. The object of the first team is for each of its members to hit the ball off the tee into the fair ball area and then reach the base which functions as the scoring area. The base includes a sound generating means so that when a player steps on the base, a sound is emitted. The object of the second team is to catch or field the ball after it is hit and before the first team's player reaches the base. When a second team member catches the ball, the batter is out. If the second team member fields the ball, he yells "Blast!" If he yells before the batter steps on the base to cause sound to be emitted, that player is out. If not, the player scores a point for his team and leaves the field.

One advantage of this game is its minimal complexity. It requires fewer players since none has to be positioned on a base. In addition, there are fewer rules for players to remember yet most of the fundamentals of baseball are preserved and required for play. The pace and safety of the game are also greatly increased since there are no wild throws and there are no collisions between players at the same base.

Another advantage of this game over other variations is that it allows more players to score more often since there is only one base to reach. Requiring a child to yell when he fields the ball and using only one, sound emitting base significantly increases the level of fun and the sense of accomplishment for young children.

Finally, by emitting sound when depressed, the base greatly increases the ease with which players can determine "safe" or "out."

Other objects, features, and advantages of the present invention will be readily appreciated as the same becomes better understood after reading the subsequent description taken in conjunction with the appendant drawings.

DETAILED DESCRIPTION OF THE PREFERRED EMBODIMENT

Figure 1:
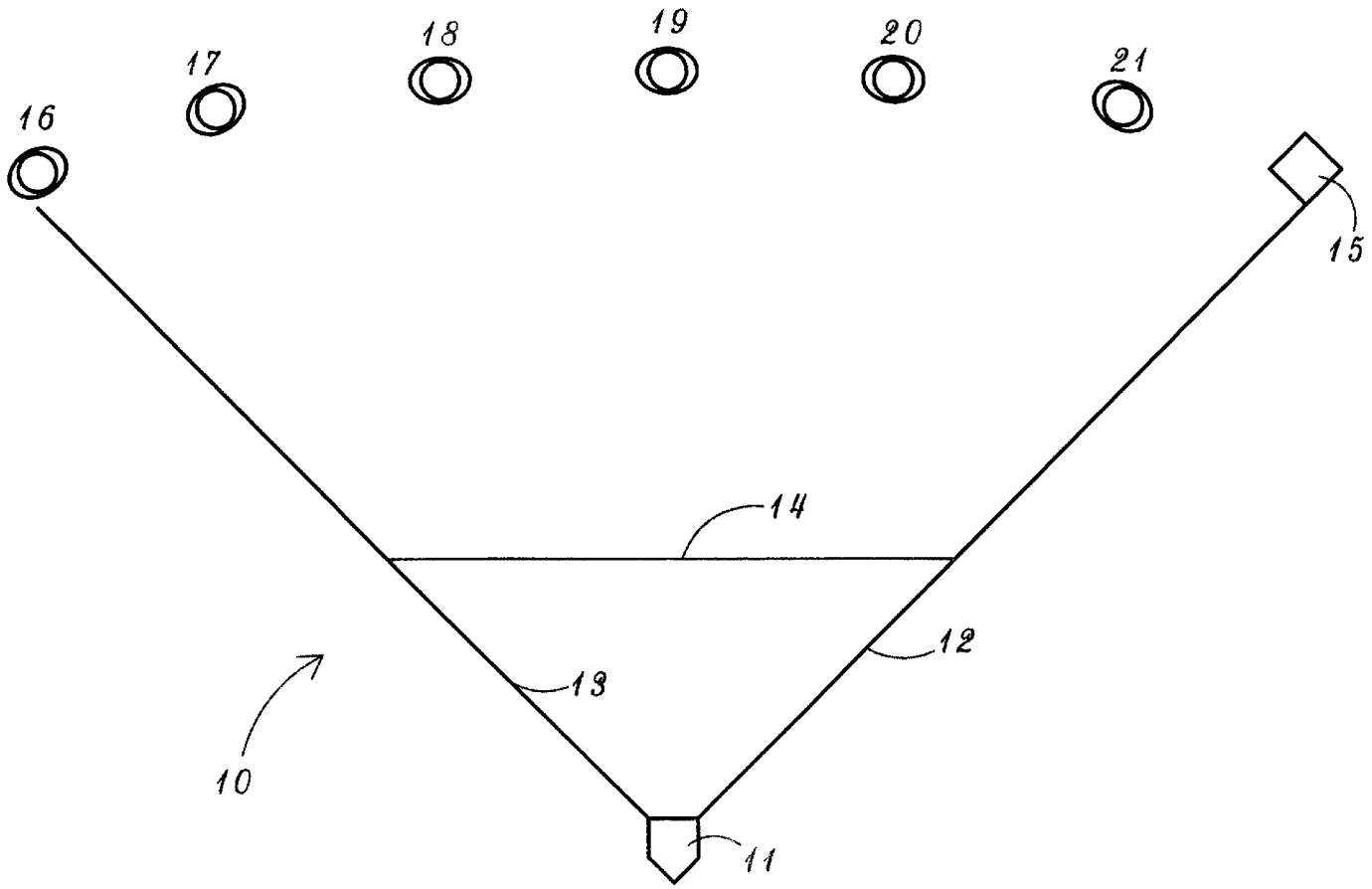
FIG. 1 is a top view of the playing field for the present invention.

The present invention involves the disclosure of a new ball game particularly designed for young children and specialized equipment for playing the game. The game is played on a playing field shown generally at 10 in FIG. 1. The playing field 10 includes a teebase 11, a right side boundary 12, and a left side boundary 13 and a minimum hit boundary 14. In the preferred embodiment, the minimum hit boundary is about 15 feet in front of teebase 11. A base 15 is placed on either boundary 12 or 13 preferably about 30 feet from teebase 11 and a boundary marker 16 is placed on the other boundary 12 or 13 at about the same distance from teebase 11, and with the boundaries 12 and 13 preferably forming a 90 degree angle. One team of five players 17–21 stands within the boundaries 12 and 13.

Figure 2:
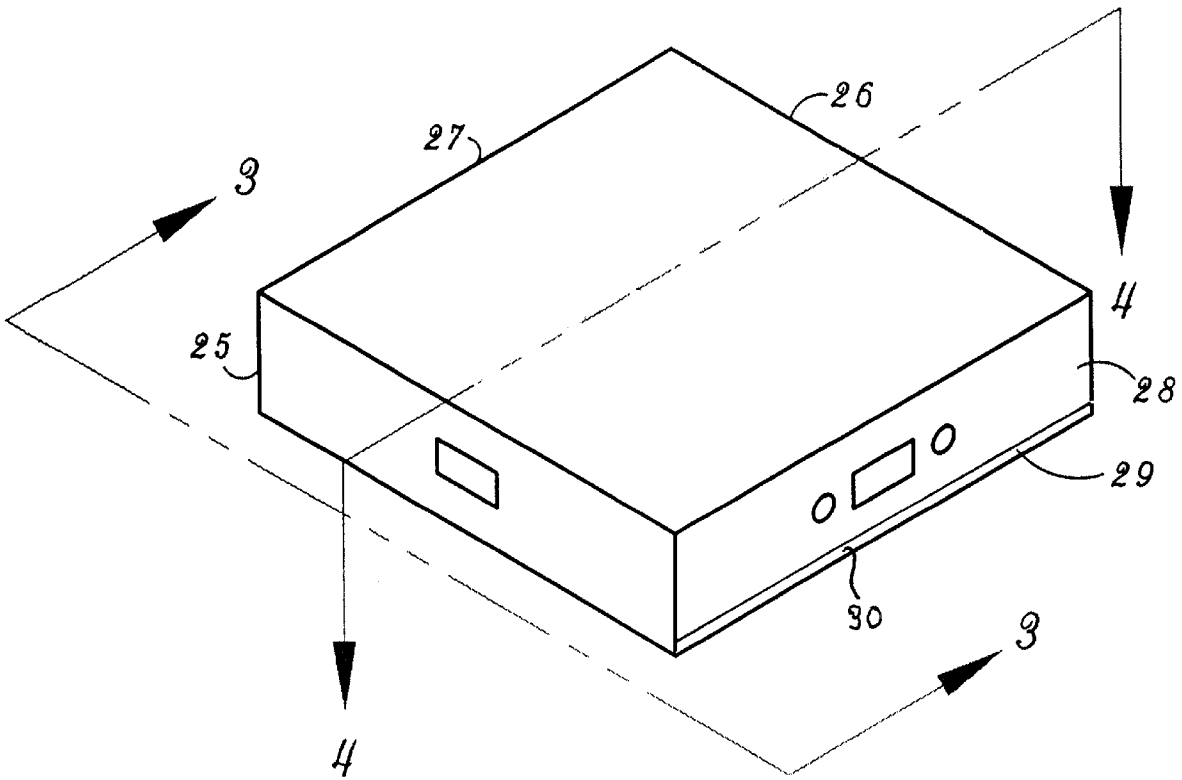
FIG. 2 is a side perspective view of a preferred embodiment of a base employed in FIG. 1.
Figure 3:
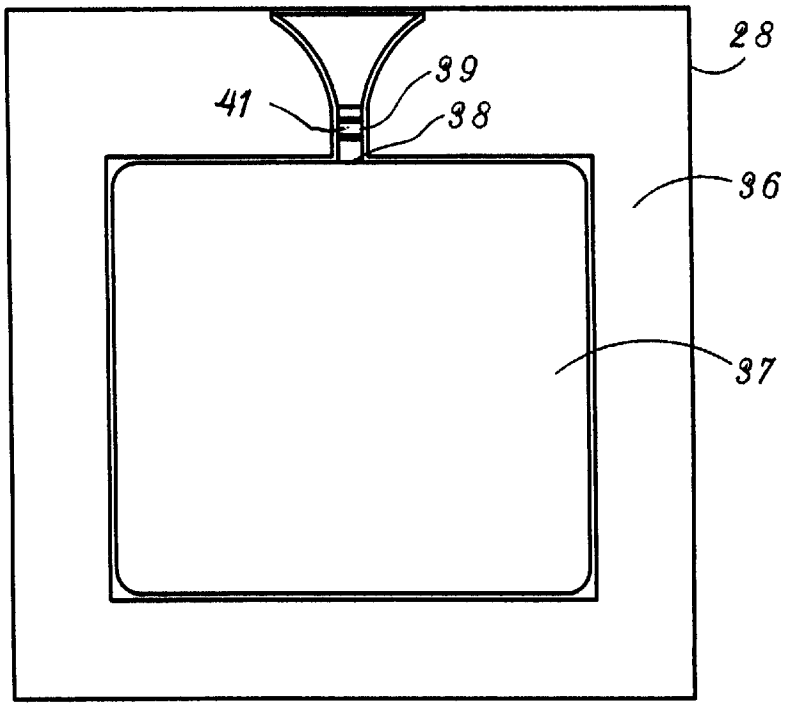
FIG. 3 is a section view of the base of FIG. 2 along the line 3—3 to show the inside structures.
Figure 4:
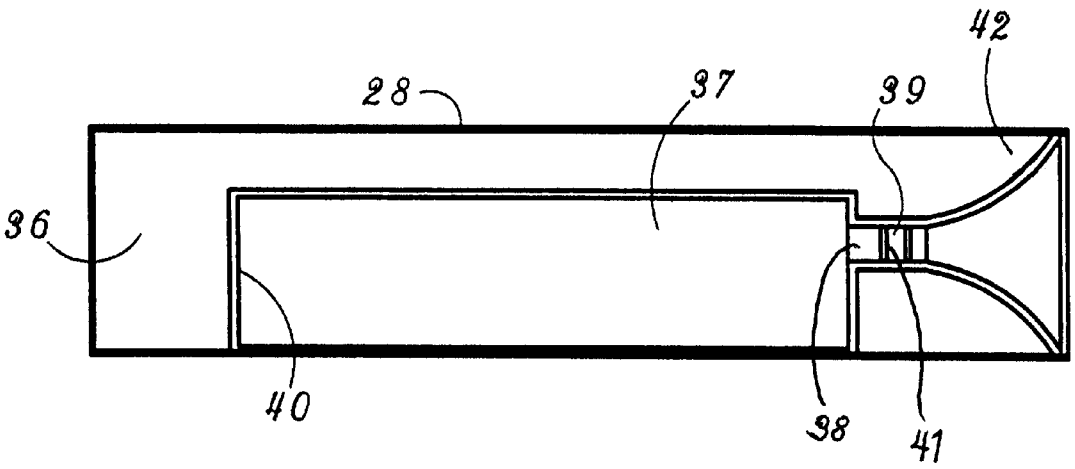
FIG. 4 is a section view of the base of FIG. 2 along the line 4—4 to show another view of the inside structures.
Figure 5:
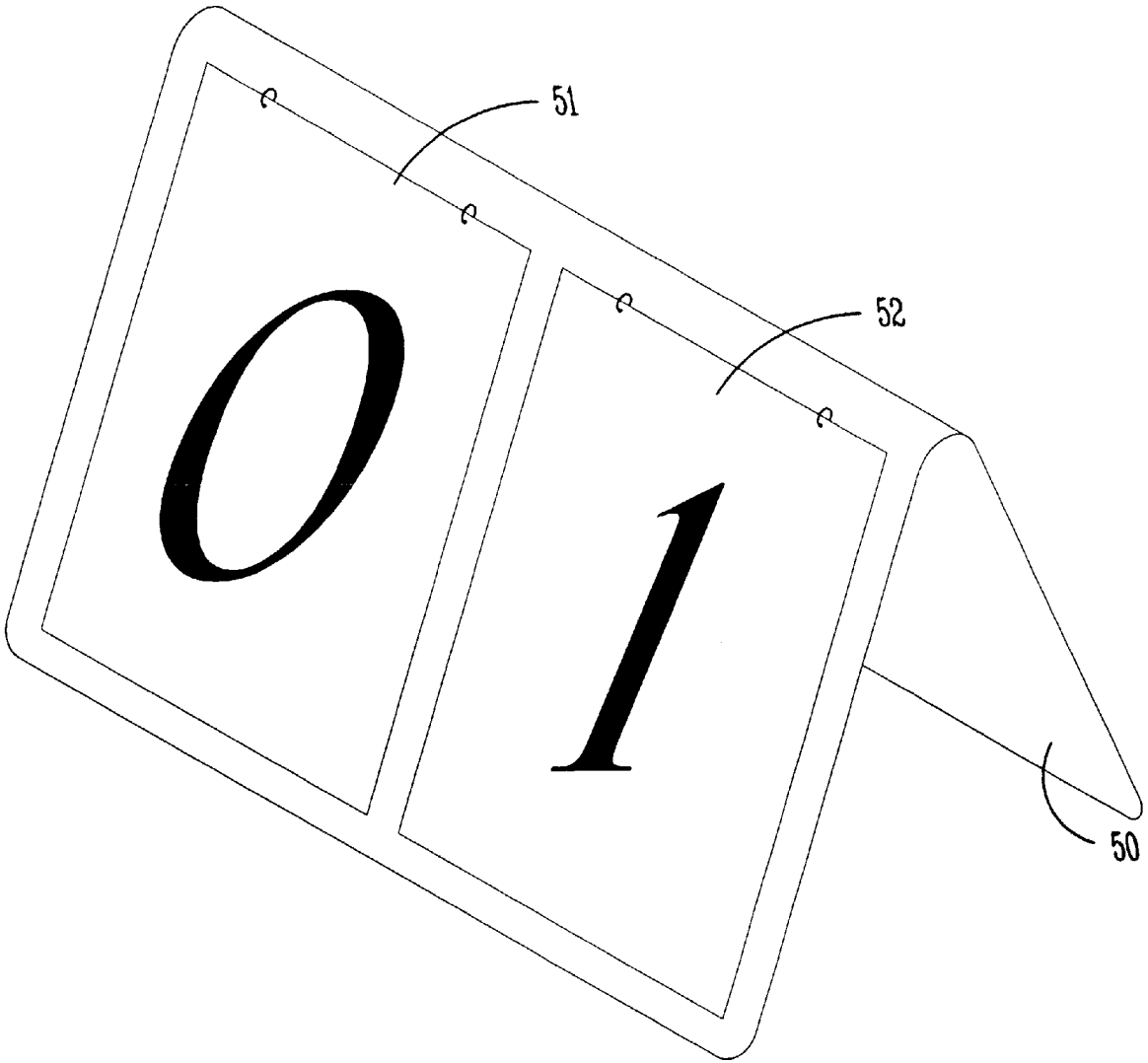
FIG. 5 is a perspective view of a self-standing score keeping device.
Figure 6:
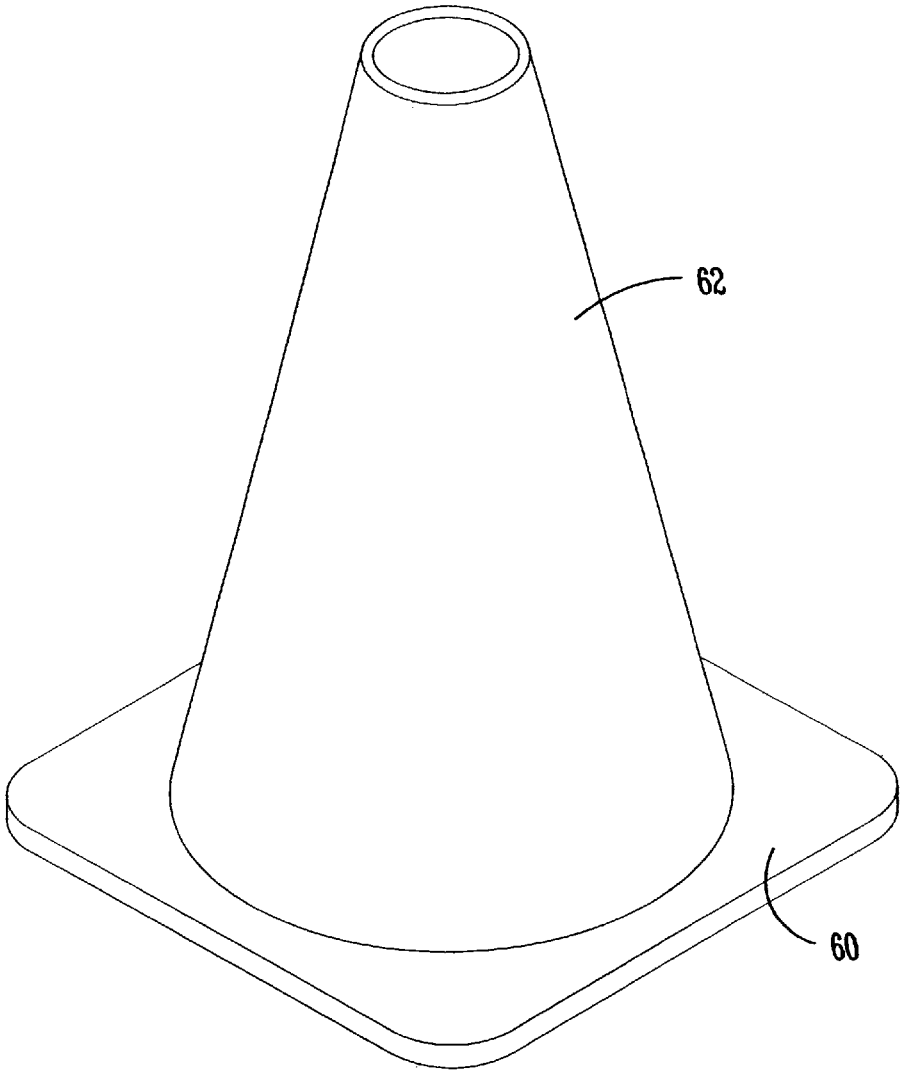
FIG. 6 is a perspective view of a boundary marker.

The base 15 is shown in FIG. 2. The preferred embodiment for the base 15 includes three dimensions 25, 26 and 27 with a relatively short depth 25 and generally rectangular in shape along the dimensions 26 and 27. The base 15 includes a housing 28 that is defined by a flexible outer sheath with a flap opening 29 at one end. In one embodiment, said flap opening 29 has velcro 30 for opening and closing. A view of the detail of the inside of the base 15 along section line 3—3 of FIG. 2 is shown in FIG. 3. The housing 28 is shown surrounding the components of the base 15 which includes a soft upper shell 36, an air retaining bladder 37 with an outlet 38, and means to attach 41 an air-pressure sensitive sound producing device 39. The soft upper shell 36, preferably formed from foam rubber, partially encases and is positioned above the air-retaining bladder 37. The bladder outlet 38 is connected to and serves as a conduit for air to the air-pressure sensitive sound producing device 39. An end view of the detail of the inside of the base 15 along section line 4—4 of FIG. 2 is shown in FIG. 4. The upper shell is formed of a rectangular configuration and has a recessed area 40 that opens to the bottom for receiving the bladder 37, and a side cut-out portion 42 in which the sound producing device 39 is positioned. Thus, the upper shell 36 serves as a protective cushion for the top and sides of the bladder 37 and the device 39.

The right side boundary 12 and left side boundary 13 of the playing field 10 of the preferred embodiment can be moved closer together for fewer players and the base 15 may be placed either closer or further from teebase 11 depending on the skill level of the players. In a preferred embodiment, boundary marker 16 is a rectangular bottom with a cone attached to its top surface. The minimum hit boundary 14 can likewise be adjusted for the skill level of the players. The preferred embodiment includes a ribbon detachable from a batting tee (not shown) which is stretched out fifteen feet in front of the tee from the right side boundary 12 to the left side boundary 13. This minimum hit boundary 14 is left on the field during play.

In the preferred embodiment, there are two opposing teams of players, each team preferably of five or more members. One player from the first team attempts to use a bat to hit a ball off a tee placed at teebase to a point beyond the minimum hit boundary and then step on the base. The players on the second team try to stop the player on the first team from stepping on the base either by catching the ball or by fielding the ball before the player on the first team steps on the base. If a player on the second team catches the ball before it touches the ground, the player on the first team is out. If a player on the second team fields the ball and yells a predetermined term such as preferably "Blast!" before the player on the first team steps on the base, the player on the first team is out. But if the player on the first team reaches the base and steps on it, causing it to emit sound, before a player on the second team fields the ball and yells "Blast!" he scores a point. The number of innings played in a game is also adjusted according to the skill level of the players and a half inning will end either with three outs or when the entire team has batted. Again, this choice should be made based on the skill level of the players. In a preferred embodiment, the score of each team is kept on a self-standing score keeping device 50 upon which are attached changeable numbers 51 and 52 and which can also serve as a boundary marker 16.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A method of playing a game comprising the steps of:

a) providing a playing field having a teebase and right side and left side boundaries;

b) providing a ball of spherical shape;

c) providing a tee upon which said ball sits;

d) providing a bat with which to hit said ball off said tee;

e) providing a base placed in a position on one of said boundaries to serve as a scoring area on said playing field, and said base comprising means to emit sound when depressed;

f) providing a first team of players wherein each team player hits said ball off said tee with said bat into said playing field and then steps on said base to cause a sound to be emitted;

g) providing a second team of players wherein said second team of players stops each of said first team players from stepping on said base before said ball is fielded when one of said second team players fields and the ball and provides a vocal indication of fielding said ball, before a first team member who hits the ball steps on the base.

2. A method of playing a game as set forth in claim 1 wherein said second team players attempt to catch said hit ball before it touches the ground.

3. A method of playing a game as set forth in claim 1 with said base comprising:

a) a housing;

b) a soft upper shell; and c) a sound generating means partially encased in said soft upper shell.

4. A method of playing a game as set forth in claim 2 with said sound generating means of said base comprising:

a) an air retaining bladder having an outlet; and b) an air-pressure sensitive sound producing device connected to said outlet.

5. A method of playing a game as set forth in claim 1 wherein first team member scores a point when he steps on said base before said second team member provides said vocal indication he has fielded said ball.

6. A method of playing a game as set forth in claim 1 wherein said second team member yells "Blast!" as said vocal indication of fielding the ball.

7. A method of playing a game as set forth in claim 1 wherein said base is located on said right boundary and said left boundary is established by a boundary marker located on said left boundary.

8. A method of playing a game as set forth in claim 1 wherein said boundary marker comprises a self-standing score keeping device comprising:

a) two sets of large, easily displayed and changeable numbers;

b) a stand with means to attach and display said sets of numbers.

9. A method of playing a game as set forth in claim 1 wherein said playing field also has a minimum hit boundary in front of said tee.

10. A method of playing a game as set forth in claim 9 wherein said minimum hit boundary is fixed by stretching a ribbon from left boundary to right boundary at a desired distance in front of said tee.

11. A method of playing a game as set forth in claim 8 with said boundary marker comprising:

a) a bottom of rectangular shape;

b) a cone attached to said bottom.

12. A method of playing a game comprising the steps of:

a) providing a playing field having a teebase, a right side boundary marked by a base, and a left side boundary marked by a self-standing scorekeeping device, said base further comprising an air retaining bladder having an outlet and an air-pressure sensitive sound producing device connected to said outlet, and said self-standing scorekeeping device further comprising two sets of large, easily displayed sets of numbers and a stand with means to attach and display said sets of numbers;

b) providing a ball of spherical shape;

c) providing a tee upon which said ball sits;

d) providing a bat with which to hit said ball off said tee;

e) providing a first team of players having as an objective for each team member to hit said ball off said tee with said bat into said playing field and then stepping on said base to cause a sound to be emitted;

f) providing a second team of players having as an objective to stop each of said first team members from stepping on said base before said ball is fielded by one of said second team players and second team player provides a vocal indication of fielding said ball by yelling "Blast!"

* * * * *